United States Patent [19]

Lanphear

[11] 4,228,979

[45] Oct. 21, 1980

[54] RIGID CHAIN SYSTEM FOR ARTICLES WITH COLUMN STRUCTURES

[76] Inventor: Marvin P. Lanphear, 2740 22nd St. La., Greely, Colo. 80631

[21] Appl. No.: 956,993

[22] Filed: Oct. 31, 1978

Related U.S. Application Data

[63] Continuation-in-part of Ser. No. 616,878, Sep. 25, 1975, Pat. No. 4,135,689.

[51] Int. Cl.[2] ..... F16M 11/20

[52] U.S. Cl. ..... 248/188.1; D6/147

[58] Field of Search ..... 248/188.1, 158; 403/292; D6/147, 151; D8/449; D11/13; 59/80

[56] References Cited

U.S. PATENT DOCUMENTS

| | | | |
|---|---|---|---|
| D. 179,527 | 1/1957 | Rubin | D6/147 |
| D. 230,231 | 2/1974 | Merritt | D6/151 X |
| 2,424,780 | 7/1947 | Trent | 403/292 X |
| 3,452,452 | 7/1969 | Dore | 403/292 X |
| 3,482,394 | 12/1969 | East | 59/80 |
| 3,771,309 | 11/1973 | Peters | 59/80 X |
| 3,802,206 | 4/1974 | Moore | 403/292 X |
| 3,945,498 | 3/1976 | Lampinen | 211/60 R |
| 4,122,666 | 10/1978 | Jessop | 59/80 |
| 4,135,689 | 1/1979 | Lanphear | 248/188.1 |

FOREIGN PATENT DOCUMENTS

| | | | |
|---|---|---|---|
| 2129469 | 1/1972 | Fed. Rep. of Germany | 59/80 |
| 529686 | 11/1940 | United Kingdom | 248/158 |

*Primary Examiner*—J. Franklin Foss

*Attorney, Agent, or Firm*—Clarence A. O'Brien; Harvey B. Jacobson

[57] ABSTRACT

The vertical posts, legs or columns of stationary structures are formed from chain-like link sections that are rigidly interconnected to provide the requisite compressive column strength. Horizontal elements are interconnected at selected heights to the vertical columns and may include rigid chain-like sections similar in construction to the vertical columns.

8 Claims, 7 Drawing Figures

RIGID CHAIN SYSTEM FOR ARTICLES WITH COLUMN STRUCTURES

BACKGROUND OF THE INVENTION

This invention relates to the construction and assemblies of different types of articles which include vertical columns such as the legs of furniture and is an improvement over the invention as disclosed and claimed in my prior co-pending application Ser. No. 616,878, filed Sept. 25, 1975, now U.S. Pat. No. 4,135,689, with respect to which the present application is a continuation-in-part.

The assembly of articles of furniture or the like from standard structural elements is well known as made of record and considered in connection with my prior co-pending application. However, the prior art teachings do not cover vertical columns or posts utilized in the construction of different types of articles and accommodating selected height connections for horizontal elements to the extent possible with the present invention. It is, therefore, an important object of the present invention to provide a vertical column construction for articles of furniture or the like that is not only very versatile in use but is also easy to fabricate and assemble.

SUMMARY OF THE INVENTION

In accordance with the present invention, different structures such as furniture which include a plurality of vertical columns, legs or posts, are made of a plurality of rigidly interconnected, chain-like link sections. Horizontal elements interconnect the vertical columns or posts in such structures and are interconnected to the vertical columns at different selected heights by means of end link sections secured to the column by means of fasteners. Each typical link sections of a column is formed by parallel spaced leg portions interconnected at opposite longitudinal ends by separate bridging portions. The bridging portions of adjacent links are formed integrally with each other from a single unitary bridge element to not only interconnect adjacent links but to also render the link chain rigid. Peg-type fasteners extend from the integral bridge element into the leg portions to hold them assembled in alignment with perpendicular planes intersecting along a common column axis.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
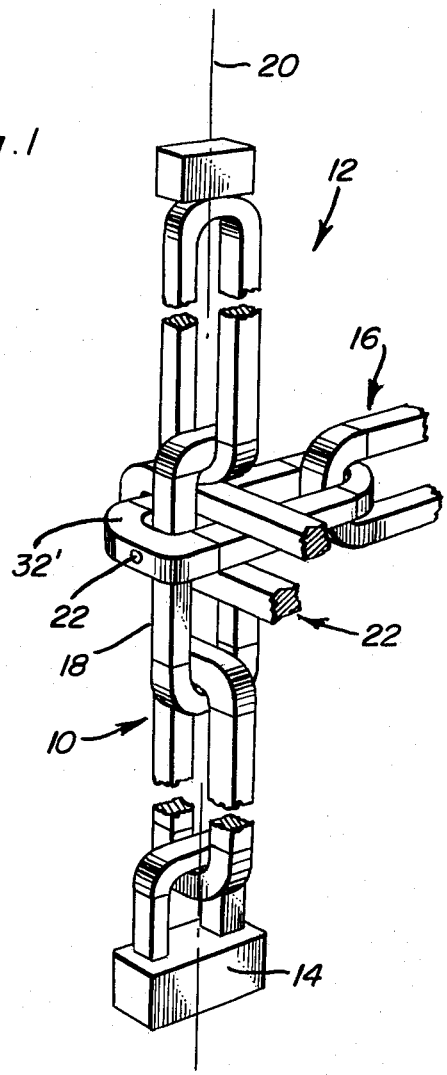
FIG. 1 is a perspective view showing a portion of an article having a column structure made in accordance with the present invention.
Figure 4:
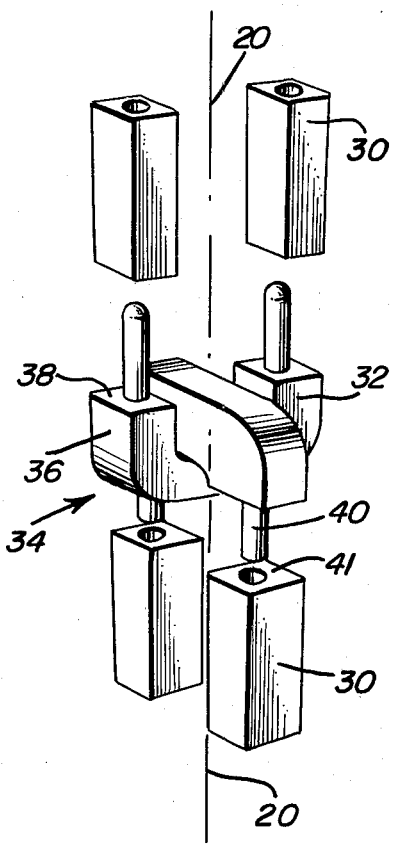
FIG. 4 is a perspective view showing disassembled portions of adjacent links forming a column structure in accordance with the present invention.
Figure 2:
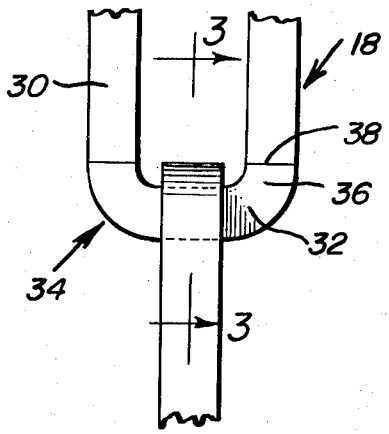
FIG. 2 is a partial front elevational view of a portion of the column structure shown in FIG. 1.
Figure 3:
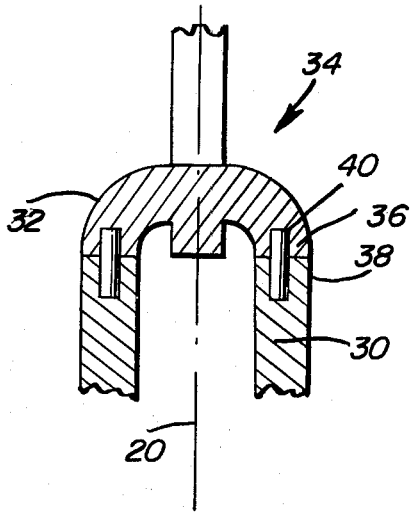
FIG. 3 is a partial sectional view taken substantially through a plane indicated by section line 3—3 in FIG. 2.

Referring now to the drawings in detail, FIG. 1 illustrates a typical column 10 associated with some stationary structure 12 constructed in accordance with the present invention. The column 10 which may be the leg of an article of furniture, has a bearing block 14 connected to a lower end thereof. A pair of such parallel spaced legs may be interconnected at a selected height as described in my prior co-pending application aforementioned.

In the illustrated embodiment of FIG. 1, the column, leg or post 10 and a horizontal element 16 are of similar construction in that they are made from material such as solid or laminated wood in the form of link sections 18. Adjacent link sections are aligned with perpendicular planes that interconnect along a common longitudinal axis 20 of the vertical column. Each typical link section 18 includes parallel spaced leg portions 30 interconnected at opposite longitudinal ends by bridging portions 32.

Adjacent bridging portions 32 of the link sections 18 are integral with each other and cross at right angles so that the link sections form a rigid column. The horizontal element 16 is connected to the vertical leg 10 and extends horizontally therefrom in perpendicular relationship to another horizontal element 22 that extends through the link section 18 embraced by the end link section of the horizontal element 16. A fastener 22 may be employed to secure the end bridging portion 32' of the horizontal element 16 to one of the leg portions 18 of the vertical leg or column 10.

In the embodiment illustrated in FIGS. 1–4, adjacent bridging portions 32 are formed as an integral bridge element 34 made of a single unitary piece of material. Each portion 32 of the bridge element 34 is aligned with a plane intersecting the plane of the other portion at right angles on the common column axis 20. Each portion 32 also includes a pair of spaced arms 36 on either side of the other bridging portion, terminating at flat coupling faces 38 aligned in parallel spaced planes perpendicular to the column axis 20 as more clearly seen in FIG. 4. The flat ends 41 of two pair of leg portions 30 abut the faces 38 and are held assembled thereon by coupling pegs 40 fitted into aligned bores in the faces 38 and abutting ends of the leg portions. Adhesive may be used to hold the parts so assembled whereby the leg portions are aligned with the two perpendicular planes intersecting at the column axis 20, said planes passing through the four pegs 40 associated with each bridge element 34.

Figure 5:
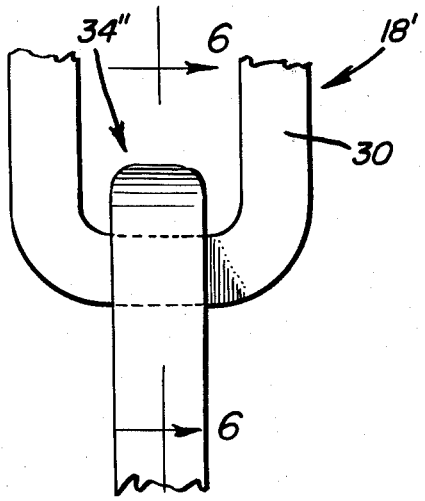
FIG. 5 is a front elevational view of a portion of a column structure in accordance with another embodiment of the invention.
Figure 6:
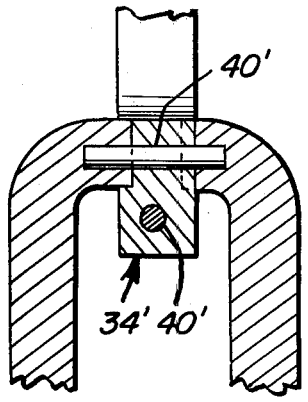
FIG. 6 is a partial sectional view taken substantially through a plane indicated by a section line 6—6 in FIG. 5.
Figure 7:
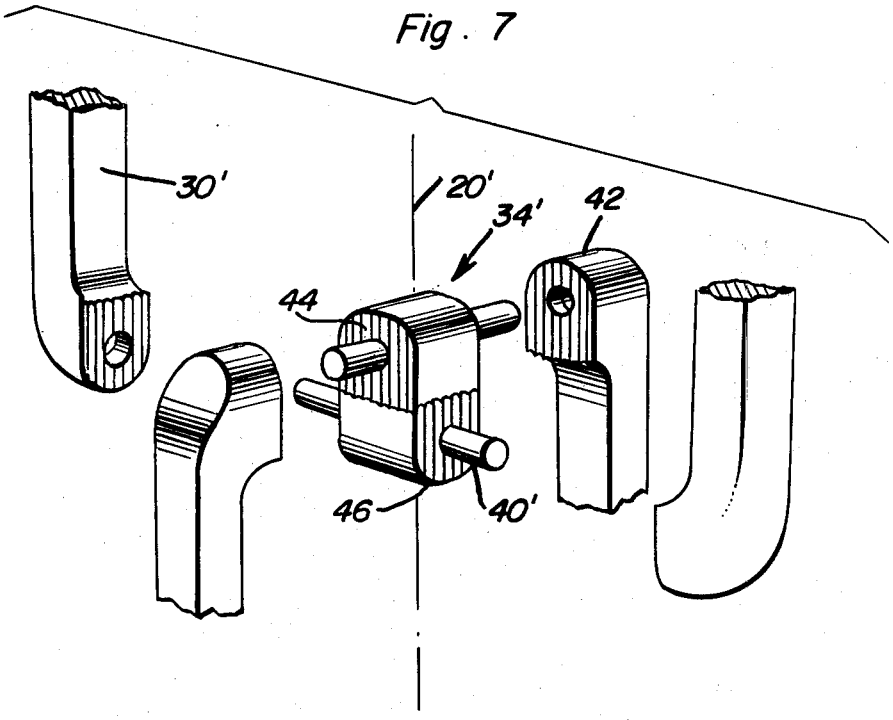
FIG. 7 is a perspective view showing disassembled portions of adjacent links forming part of a column structure in accordance with the embodiment illustrated in FIGS. 5 and 6.

FIGS. 5, 6 and 7 illustrate another embodiment of the invention wherein the column is formed by links 18' interconnected by bridge elements 34'. Two elongated coupling pegs 40' extend through each bridge element in vertically spaced perpendicular relation to each other as more clearly seen in FIG. 7, in order to interconnect two pair of leg portions 30' associated with adjacent links 18' and hold each pair in perpendicular relation relative to a common column axis 20' extending through the bridge elements 34'. The four projecting ends of the pegs 40' are received in bores formed in confronting faces 42 of each pair of leg portions 30'. Upper and lower pairs of mating faces 44 and 46 are formed on the bridge element 34' aligned with perpendicular planes. The faces 42 thus abut the faces 44 and 46 when the column is assembled and may be provided with interengaging grooves.

The abutting faces 42, 44 and 46 according to the embodiment of FIGS. 5–7 are grooved to prevent lateral shear of the pegs 40' in horizontal directions. The pegs 40' are supported intermediate the ends by the bridge elements 34' to transfer axial column forces thereto from the leg portions as compared to the pegs 40 in the embodiment of FIGS. 1–4 wherein axial column forces are transferred through the abutting faces 38 of the leg portions to the bridge elements 34. The pegs 40 in such case must only resist lateral shear in horizontal directions and are not stressed by axial column forces as in the case pegs 40'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a load supporting article having a horizontal element interconnected between at least two rigid vertical columns, each of said columns having a plurality of chain-like link sections, adjacent ones of the link sections being aligned with perpendicular planes intersecting along a common column axis, each of the link sections comprising solid leg portions and bridging portions rigidly interconnecting the leg portions at opposite longitudinal ends thereof, the bridging portions of the adjacent link sections being formed by a single unitary piece of material, and coupling means holding the bridging portions in rigid assembled relation to the leg portions for alignment with said perpendicular planes.

2. The combination of claim 1 wherein said horizontal element includes a plurality of chain-like link sections geometrically similar to the link sections of the vertical columns.

3. In a load supporting structure having a horizontal element interconnected with a rigid vertical column having a plurality of chain-like link sections, wherein adjacent link sections are aligned with perpendicular planes intersecting along a common column axis, each of the link sections comprising solid leg portions and separate bridging portions rigidly interconnecting the leg portions at opposite longitudinal ends thereof, the bridging portions of adjacent link sections being formed as an integral bridge element made of a single unitary piece of material, and means for holding the leg portions rigidly assembled to said bridge element parallel to the common column axis.

4. The combination of claim 3 wherein said horizontal element includes a plurality of chain-like link sections geometrically similar to the link sections of the vertical columns.

5. In a load supporting structure having a horizontal element interconnected with a rigid vertical column having a plurality of chain-like link sections, wherein adjacent link sections are aligned with perpendicular planes intersecting along a common column axis, each of the link sections comprising spaced leg portions and separate bridging portions interconnecting the leg portions at opposite longitudinal ends thereof, the bridging portions of adjacent link sections being formed as an integral bridge element made of a single unitary piece of material, and means for holding the leg portions assembled to said bridge element, each of said bridge elements having four coupling faces, the leg portions interconnected by the bridge element having end faces engageable with said coupling faces, and coupling means extending between said bridge element and the leg portions through each of said engaged coupling and end faces.

6. The combination of claim 5 wherein the engaged faces associated with each of said bridge elements lie in parallel planes perpendicular to the common column axis.

7. The combination of claim 5 wherein the engaged faces associated with each of said bridge elements are parallel to the common column axis.

8. The combination of claim 7 wherein said engaged faces are grooved.

* * * * *